United States Patent [19]

Cotton, Jr. et al.

[11] 4,384,505

[45] May 24, 1983

[54] CHORUS GENERATOR SYSTEM

[75] Inventors: Robert B. Cotton, Jr., Erlanger, Ky.; Dale M. Uetrecht, Colerain Township, Hamilton County; Russell L. Withington, Cincinnati, both of Ohio

[73] Assignee: Baldwin Piano & Organ Company, Cincinnati, Ohio

[21] Appl. No.: 162,540

[22] Filed: Jun. 24, 1980

[51] Int. Cl.[3] ..... G10H 1/02

[52] U.S. Cl. ..... 84/1.24; 84/1.25; 84/DIG. 4

[58] Field of Search ..... 84/1.01, DIG. 4, 1.03, 84/1.24, 1.25; 364/718

[56] References Cited

U.S. PATENT DOCUMENTS

| | | | |
|---|---|---|---|
| 3,004,460 | 10/1961 | Wayne | 84/1.01 |
| 3,007,361 | 11/1961 | Wayne | 84/1.01 |
| 3,215,767 | 11/1965 | Martin | 84/1.24 |
| 3,257,495 | 6/1966 | Williams | 84/1.25 |
| 3,336,432 | 8/1967 | Hurvitz | 84/1.01 |
| 3,479,440 | 11/1969 | Martin et al. | 84/1.25 |
| 3,515,792 | 6/1970 | Deutsch | 84/1.03 |
| 3,516,318 | 6/1970 | Wayne | 84/1.01 |
| 3,626,077 | 12/1971 | Munch et al. | 84/1.24 |
| 3,833,752 | 9/1974 | Van der Kooij | 84/1.24 |
| 3,866,505 | 2/1975 | Adachi | 84/1.24 |
| 4,038,898 | 8/1977 | Kniepkamp et al. | 84/1.24 |
| 4,043,243 | 8/1977 | Peterson | 84/1.25 |
| 4,080,861 | 3/1978 | Wholahan | 84/1.24 |
| 4,096,778 | 6/1978 | Dittmar | 84/1.25 |
| 4,144,790 | 3/1979 | Suchoff | 84/1.24 |
| 4,225,936 | 9/1980 | Lesche | 364/718 |
| 4,283,768 | 8/1981 | Scott | 364/718 |

OTHER PUBLICATIONS

M. V. Mathews, "The Digital Computer as a Musical Instrument", *Science*, vol. 1, pp. 553–557, Nov. 1, 1963.

H. R. Schindler, "Delta Modulation", *IEEE Spectrum*, Oct. 1970, pp. 69–78.

*Electronic Engineers' Handbook*, Sec. 14–36, 14–43, and 14–44, (1st Ed., 1975, McGraw-Hill Book Company).

J. Abate, "Linear and Adaptive Delta Modulation", *Proceedings of the IEEE*, vol. 55, No. 3, Mar. 1967, pp. 298–308.

Rabiner and Schafer, *Digital Processing of Speech Signals*, Sec. 5.6, p. 216, (1978 Prentice-Hall, Inc.).

*Primary Examiner*—J. V. Truhe
*Assistant Examiner*—Forester W. Isen
*Attorney, Agent, or Firm*—Kirkland & Ellis

[57] ABSTRACT

A string chorus generator in an electronic musical instrument that accepts a single audio input signal, applies it to three separate delay lines, and provides delay modulated outputs to be used in producing an ensemble musical effect resembling a group of strings in a string orchestra. Each of the three delay line channels is identical and comprises an analog shift register driven by a high frequency voltage-controlled oscillator along with appropriate filters and buffers. The frequency of the voltage-controlled oscillator of each channel is controlled by the filtered output of a microprocessor, thereby providing precise control over the modulation of each voltage-controlled oscillator. The modulating waveshape is generated by using a lookup table within a microprocessor and comprises a sine wave of 6.25 Hz superimposed on another, larger amplitude, sine wave of 0.78 Hz. In order to provide an even chorus effect, in one embodiment period-proportional voltage controlled oscillators are used so that the high frequency modulation component of each waveshape has the same modulating effect on the audio signal at all times, regardless of the instantaneous amplitude of the low frequency modulation component. In another embodiment, the values stored in the lookup table are chosen so that distortion does not occur when frequency-proportional voltage-controlled oscillators are used.

16 Claims, 3 Drawing Figures

CHORUS GENERATOR SYSTEM

BACKGROUND OF THE INVENTION

1. Field of the Invention

The present invention relates to a string chorus generator in an electronic musical instrument that accepts a single audio input signal, applies it to three separate delay lines which are modulated by signals provided from a lookup table by a microprocessor, and provides three audio output signals which are used to produce an ensemble effect.

2. Description of the Prior Art

Apparatus for providing ensemble effects in electrical musical instruments are known in the prior art. Various types of such apparatus which utilize delay lines modulated by low-frequency signals are described in U.S. Pat. No. 3,833,742—van der Kooij; U.S. Pat. No. 3,866,505—Adachi; U.S. Pat. No. 4,038,898—Kniepkamp et al.; U.S. Pat. No. 4,043,243—Peterson; U.S. Pat. No. 4,080,861—Wholahan; U.S. Pat. No. 4,144,790—Suchoff; and U.S. Pat. No. 4,096,778—Dittmar.

Apparatus for providing ensemble effects described in prior art patents utilize a plurality of delay line channels, each of which receives an audio signal which is delay modulated by an analog delay line or shift register clocked by a voltage-controlled oscillator. The output of such shift registers is then filtered and fed to an audio output system. The voltage-controlled oscillators are modulated by a low frequency (sub-audio) signal provided by one or more low frequency oscillators. In some instances, two or more sub-audio frequency signals of different frequencies are summed or superimposed upon one another before being applied to the modulation inputs of voltage-controlled oscillators. Non-linear circuits are used to compensate for the distortion which otherwise occurs to the audio signal being delay modulated as a result of superimposed modulating signals being applied to voltage-controlled oscillators which produce output signals of a frequency directly proportional to the modulating signal. Such non-linear circuits are used either to compensate the modulation control signal applied to the voltage-controlled oscillator or to compensate the clock signals provided by the voltage-controlled oscillator. In other types of prior art apparatus, two or more sub-audio signals are used as modulating signals but the sub-audio signals are applied to separate voltage-controlled oscillators (rather than being superimposed) to minimize distortion to the audio signal. Also, phase shifter networks are used in prior art apparatus in order to provide a plurality of modulation control voltage signals of different phases so that the delay line channels are modulated in predetermined phase relationships with one another rather than in the same phase. Variations are also provided in which, for example, different audio signals are applied to each of the delay line channels, or in which the delay line circuits are connected in series.

Unlike the systems in the prior art for generating ensemble effects, the present invention does not use low-frequency oscillators for controlling the voltage-controlled oscillators which provide clock pulse signals for driving delay lines, the low-frequency oscillators being replaced in the present invention by a lookup table in a microprocessor. Phase-delay networks are also unnecessary in the present invention, the desired phase difference in modulation control voltage signals being provided by the microprocessor when it scans three locations (i.e., one location per modulation control signal) of a common lookup table simultaneously to generate pulse trains corresponding to three independent modulation control signals. Further, in the preferred embodiment of the present invention which utilizes period-proportional voltage-controlled oscillators, non-linear circuits are not needed to compensate for the non-linear relationship between delay and modulation control voltage which results when frequency-proportional voltage-controlled oscillators are utilized. In another embodiment, by properly determining the values stored in the lookup table, modulation control voltage signals are provided by the microprocessor which compensate for the non-linear relationship so that when such signals are applied to frequency-proportional voltage-controlled oscillators, the delay modulation which results is similar to that obtained in the preferred embodiment using uncompensated modulation control voltage signals and period-proportional voltage-controlled oscillators. That is, by properly determining the values stored in the lookup table, the present invention renders unnecessary the phase shifter circuits and non-linear compensating circuits required by prior art apparatus when frequency-proportional voltage-controlled oscillators are used to provide clock signals for analog delay lines.

SUMMARY OF THE INVENTION

The present invention is a string chorus generator in an electronic musical instrument that accepts a single audio input signal, applies it to three separate delay line channels and provides outputs which produce an ensemble effect. Each of the three identical delay line channels comprises an analog shift register driven by a high frequency voltage-controlled oscillator. The frequency of the voltage-controlled oscillator is controlled by the filtered output of a microprocessor.

The microprocessor provides three outputs that are low-pass filtered to create three waveforms to drive the three voltage-controlled oscillators. Although it would be feasible for the processor to calculate the waveforms, less processing time is required when the waveforms are stored in a lookup table. In the system of the present invention, the processor uses a lookup table thirty-two bytes long to output three pulse trains of 256 bits each. Since output information is updated with the next table bit every five milliseconds, the period of the output pulse train is five milliseconds times 256 bits, or 1.28 seconds. The three waveshapes are identical, but are kept 120 degrees out of phase with each other to create a smooth chorus effect. The 120-degree phase shift is obtained by reading the next table bit for each of the three waveforms simultaneously from three different locations in the lookup table. Using this lookup table approach, a variety of modulating waveshapes could be generated, although the best chorus effect has been achieved with a sine wave of the above-mentioned 1.28 second period, along with a superimposed sine wave of eight times that frequency. Thus, each filtered processor output is a sine wave of 6.25 Hz ($f_{mh}$) (high frequency modulation component) superimposed on another, larger amplitude, sine-wave of 0.78 Hz ($f_{ml}$) (low frequency modulation component). Since the three output waveshapes are stored in a lookup table in the microprocessor, precise control over the modulation frequency is obtained, eliminating the need for adjustment of external oscillators, dividers or phase shifting networks.

The three waveshapes generated by the microprocessor are used to modulate the frequencies of three voltage-controlled oscillators that clock three analog shift registers. To achieve an even chorus effect, it is essential that the $f_{mh}$ component of each waveshape have the same modulating effect on the audio signal at all times, regardless of the instantaneous voltage of the $f_{ml}$ component. An even chorus effect is achieved when the audio signal is delayed without being distorted. Distortion occurs in prior art systems when the outputs of two low-frequency oscillators are combined to provide the modulation control voltage where the modulation control voltage is used to control a frequency-proportional voltage-controlled oscillator.

The present invention makes it possible to produce delay without distortion when a frequency-proportional voltage-controlled oscillator is used to clock the delay line. In this embodiment, the microprocessor produces and $f_{mh}$ signal having an amplitude that varies in time as a function of the instantaneous value of the $f_{ml}$ signal. This distortion problem is also overcome in an other embodiment of the present invention which uses an oscillator having a period that is directly proportional to its modulation control voltage, thereby obviating the need for the $f_{mh}$ signal to vary as a function of the $f_{ml}$ signal.

DETAILED DESCRIPTION OF THE PREFERRED EMBODIMENT

Figure 1:
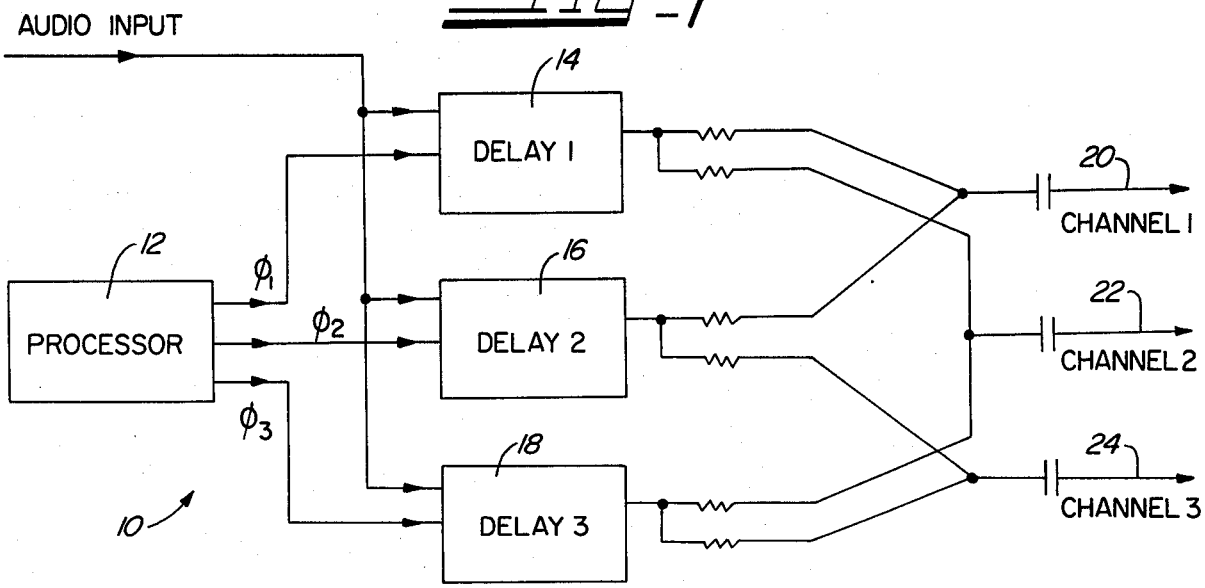
FIG. 1 is a block diagram of the chorus generator system of the present invention.

With reference to FIG. 1, a block diagram is shown of the string chorus generator 10 of the present invention. Microprocessor 12 provides three waveforms which are used to drive delay lines 14, 16 and 18, respectively. The output of each delay line 14, 16 and 18 is combined with the output of one of the other two delay lines to provide channels 20, 22 and 24. The audio signals on channels 20, 22 and 24 produce an ensemble effect when sounded by a three-channel acoustic output system (not shown). In addition to receiving one of the three waveshapes provided by microprocessor 12, each of delay lines 14, 16 and 18 has an audio input for receiving an audio signal from an audio source (not shown) to be delay modulated. Although shown as a single audio input signal applied to all three delay lines 14, 16 and 18 in FIG. 1, separate audio input signals could be applied to two or more of the delay lines in variations of the present invention.

Figure 2:
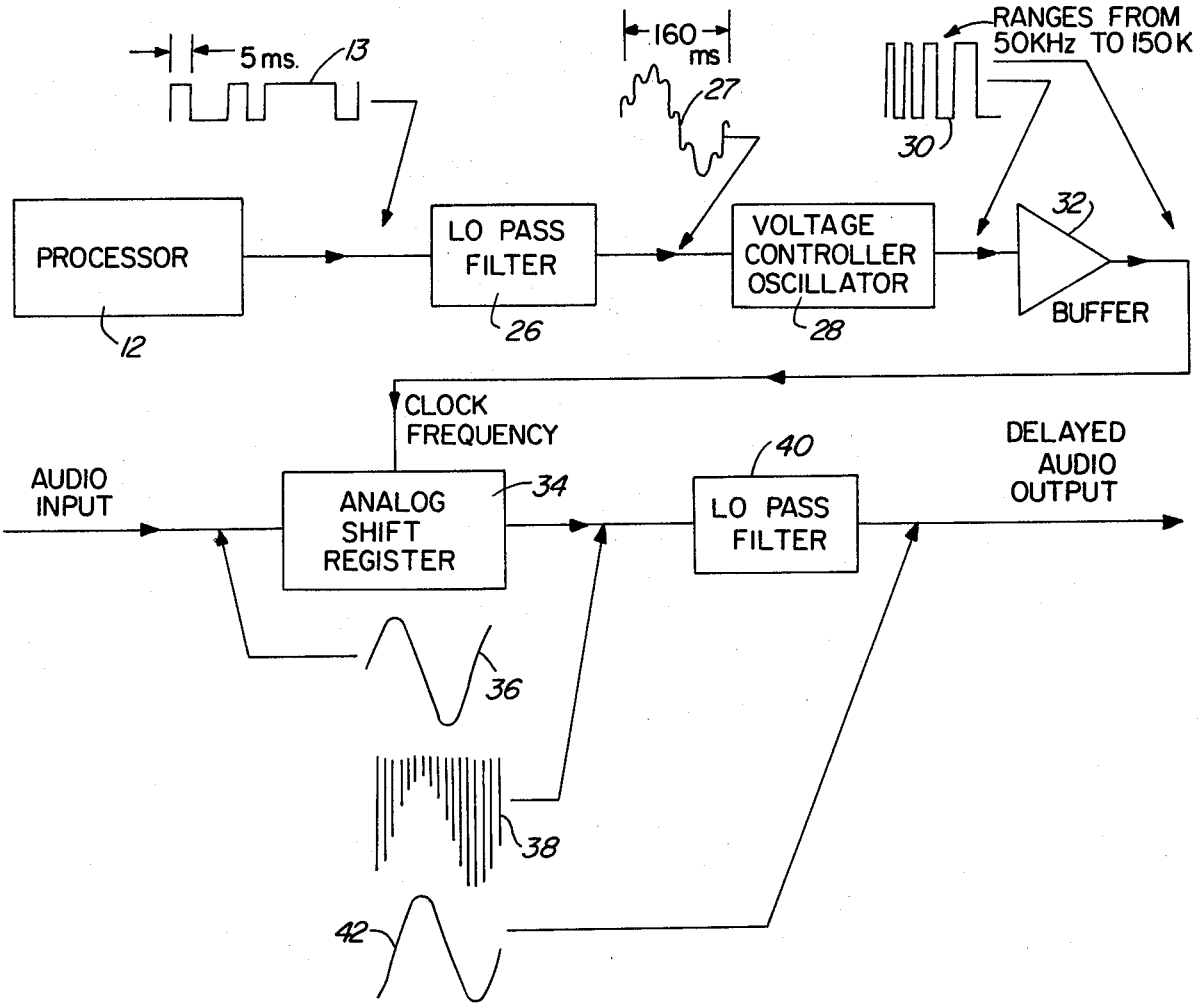
FIG. 2 is a block diagram showing one of the three identical channels of the preferred embodiment of the chorus generator system.

The microprocessor 12 provides three outputs, as illustrated in FIG. 1, which, as illustrated in FIG. 2, are low pass filtered (e.g, by low pass filter 26) to create waveforms or modulation control signals to drive the three voltage-controlled oscillators (e.g., voltage-controlled oscillator 28). The creation of these three waveforms by microprocessor 12 in the present invention is related to the known techniques described in the following prior art references: U.S. Pat. No. 3,515,792—Deutsch, issued June 2, 1970; M. V. Mathews "The Digital Computer as a Musical Instrument", *Science*, vol. 1, p. 553, Nov. 1, 1963; H. R. Schindler, "Delta Modulation", *IEEE Spectrum*, October 1970, p. 69; *Electronics Engineers' Handbook*, Sec. 14-36, 14-43 and 14-44 (1st ed. 1975, McGraw-Hill Book Company); J. Abate, "Linear and Adaptive Delta Modulation", *Proceedings of the IEEE*, vol. 55, no. 3, March, 1967, p. 298; and Rabiner and Schafer, *Digital Processing of Speech Signals*, Sec. 5.6, p. 216 (1978 Prentice-Hall, Inc.). Although it would be feasible for the microprocessor 12 to actually calculate the waveforms, less processing time is required when the waveforms are stored in a lookup table (not shown) within microprocessor 12. A microprocessor suitable for providing three pulse trains from a ROM is described in Mosteck Publication No. MK79567, entitled "Mosteck F8 Microcomputer Devices, Single-Chip Microcomputer MK3872," (Mostek Corporation 1978). In the string chorus generator system of the present invention, the microprocessor 12 uses a lookup table 32 bytes long to provide three pulse trains of 256 bits each. In another embodiment, microprocessor 12 is replaced by a sequential addressing means and digital memory means comprising, for example, a read only memory (ROM) in which is stored the lookup table and to which access is controlled by a counter in a known manner. In one embodiment, output information is updated with the next table bit every five milliseconds; therefore, the period of the output pulse train is five milliseconds times 256 bits, or 1.28 seconds. The three waveforms (e.g., digital signal 13) are identical, but are kept 120 degrees out of phase with each other to create a smooth chorus effect. The desired 120-degree phase shift is obtained by reading the next table bit for each of the three waveforms simultaneously from three different locations (each spaced one-third of a period apart) in the common lookup table. By appropriately selecting the relative locations in the lookup table, any desired phase shift between waveforms is readily obtainable. Furthermore, the number of locations to be read simultaneously can be increased or decreased to coincide with a greater or fewer number of delay line channels without affecting the size of the lookup table. Also, for greater versatility a separate lookup table could be used to provide a different waveform for each modulation control signal. Using this lookup table approach, a variety of modulating wave shapes could be generated, although the best chorus effect has been achieved with a sine wave having a period of 1.28 seconds along with a superimposed sine wave of eight times that frequency (i.e, the eighth harmonic). Thus, each filtered processor output (e.g., signal 27 in FIG. 2) is a sine wave of 6.25 Hz ($f_{mh}$) (high frequency modulation component) superimposed on another, larger amplitude sine wave of 0.78 Hz ($f_{ml}$) (low frequency modulation component). Since the three outputs are stored in the microprocessor 12 in a lookup table, precise control of the frequency and phase for each delay line channel is obtained, thereby eliminating the need for adjustment of external oscillators, phase shifters, or dividers as required in prior art systems.

With reference to FIG. 2, the signal path for one of the three delay lines 14, 16 or 18 of the present invention is shown. Since the delay circuits 14, 16 and 18 in FIG. 1 are identical, only one delay circuit is illustrated in FIG. 2. The waveshape provided by microprocessor 12 is passed through low-pass filter 26, which transforms the digital waveform 13 provided by microprocessor 12 into a substantially sinusoidal analog waveform 27. Analog waveform 27 is applied to voltage-controlled oscillator 28 as the modulation control voltage signal. The modulation control voltage signal 27 causes voltage-controlled oscillator 28 to modulate the period of the output clock signal 30 produced by voltage-controlled oscillator 28 at its output. Clock signal 30 is conditioned by buffer amplifier 32 to drive analog shift register 34. Analog shift register 34 delays audio input signal 36 by an amount directly proportional to the period of clock signal 30 to provide at the output of analog shift register 34 the delayed signal 38.

As is generally known, an analog delay line or shift register (such as analog shift register 34) operates by sampling the incoming signal into consecutive pulses of an amplitude proportional to the instantaneous amplitude of the incoming signal at the time of sampling. An audio signal applied to the input of the shift register is sampled with the frequency of the clock pulses of a first clock signal and is transmitted or shifted to successive stages by alternately clocking with a second clock signal of the same frequency. Each sample of the input audio signal reaches the output of the shift register after $n/2f_c$ seconds, where n is the number of stages in the shift register (or "buckets" in the "bucket brigade") and $f_c$ is the frequency of the clock signal, which in the present invention is provided by the voltage-controlled oscillator. Thus, it is apparent that delay is directly proportional to the period (the inverse of the frequency) of the clock signal.

Delayed signal 38 is in digital form and therefore is passed through low-pass filter 40 to remove the clock signal and provide delayed audio output signal 42, which corresponds to the envelope of delayed signal 38. The delayed signal 42 from each of delay circuits 14, 16 and 18 is then routed to two of the three output channels 20, 22 and 24. A smoother chorus effect is achieved in the preferred embodiment by summing pairs of the delayed audio output signals 42, e.g., the sum of the outputs of delay lines 14 and 16 provide the output on channel 20, the sum of the outputs of delay lines 14 and 18 provide the output on channel 22, and the output of delay lines 16 and 18 provide the output on channel 24.

In the preferred embodiment three waveforms generated by the microprocessor 12 are used to modulate the frequencies of the three voltage-controlled oscillators (e.g., voltage-controlled oscillator 28) that clock the analog shift registers (e.g., analog shift register 34). As discussed above, the string chorus modulating waveform 13 (see FIG. 2) consists of two added frequencies, $f_{mh}$ and $f_{ml}$. To achieve an even chorus effect, it is essential that the $f_{mh}$ component of each waveshape have the same modulating effect on the audio signal at any instant in time, regardless of the instantaneous amplitude of the $f_{ml}$ component. This even chorus effect is achieved in one embodiment of the present invention by the use of a period-proportional voltage-controlled oscillator 28 which produces an output clock signal having a period that is directly proportional to the modulation control signal. Such a period-proportional voltage-controlled oscillator is described in the co-pending application, "Delay Line Oscillator", Ser. No. 162,631, filed June 24, 1980, and assigned to the same assignee as the present invention. If a period-proportional oscillator 28 is used, and the amplitude of $f_{mh}$ does not vary as a function of $f_{ml}$, and $f_{mh}$ component will produce the same amount of audio modulation regardless of the instantaneous level of the $f_{ml}$ component. In addition to assuring even string chorus modulation, the period-proportional voltage-controlled oscillator allows wider tolerance of the oscillator's center frequency; because the modulation is directly proportional to the modulation control voltage swing, the center frequency of the oscillator does not change the modulation effect. This allows the system to be mass produced without calibration adjustments.

If a frequency-proportional voltage-controlled oscillator is used, an even chorus effect is not achieved unless the processor 12 produces an $f_{mh}$ amplitude that varies with time as a function of the instantaneous value of $f_{ml}$. In another embodiment of the present invention, frequency-proportional voltage controlled oscillators can be utilized without the usual, attendant distortion. This is achieved by programming the lookup table in microprocessor 12 so that the amplitude of the $f_{mh}$ signal varies with time as a function of the instantaneous value of $f_{ml}$. By compensating the amplitude of the modulation control signal in this manner, it is possible to modulate the clock signals so that their period varies linearly with the uncompensated modulation control signal. That is, the modulation effect is equivalent to what is achieved with a period-proportional voltage-controlled oscillator and uncompensated $f_{mh}$ and $f_{ml}$ modulation signal components.

Figure 3:
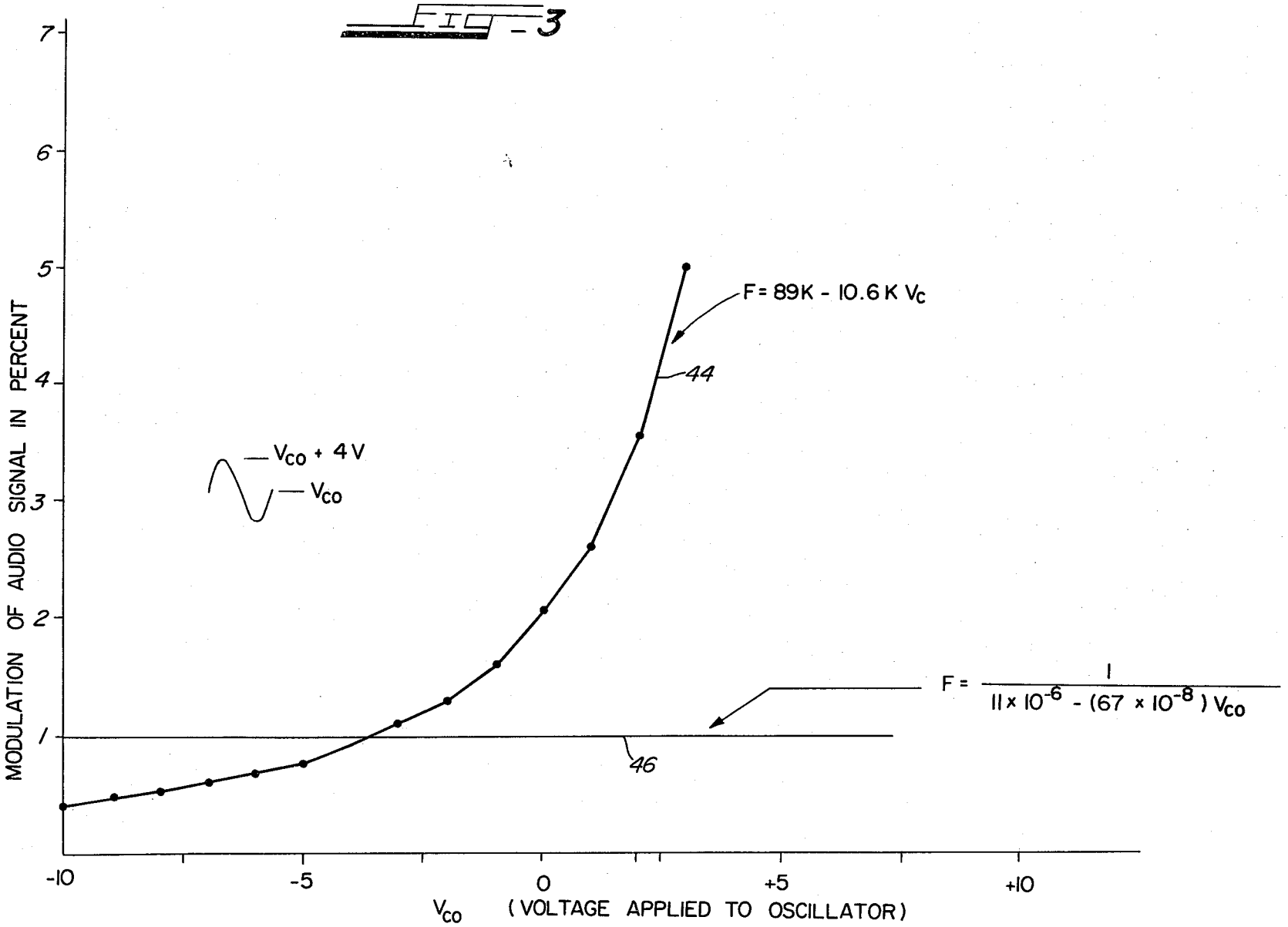
FIG. 3 is a graph illustrating the relationship between percent modulation of an audio signal and the modulation control voltage for a period-proportional voltage-controlled oscillator and for a frequency-proportional voltage-controlled oscillator where the $f_{mh}$ signal does not vary as a function of the instantaneous value of $f_{ml}$.

Since the delay introduced by analog shift register 34 is proportional to $1/f_c$, or the clock period, the change in delay is directly proportional to the change in clock period. When a period-proportional voltage-controlled oscillator is used the period of the oscillator is directly proportional to its control voltage so that the change in delay, and hence the audio frequency modulation, are also directly proportional to the modulation control-voltage. This is illustrated in FIG. 3, which shows the relationship between the percentage modulation of the audio signal and the modulation control-voltage. To obtain the curves in FIG. 3, a control voltage of 4 volts peak-to-peak with a dc level varying from −10 volts to +5 volts was applied to a period-proportional voltage-controlled oscillator and a frequency-proportional voltage-controlled oscillator. Curve 44 illustrates the nonlinear relationship which results when a frequency-proportional voltage-controlled oscillator is used (and where the instantaneous value of the $f_{mh}$ modulation signal component does not vary as a function of the $f_{ml}$ component), and curve 46 shows the linear relationship which results when a period-proportional voltage-controlled oscillator is used. FIG. 3 illustrates that the percent of modulation of the audio signal varies widely for the frequency-proportional voltage-controlled oscillator (see curve 44), while remaining relatively constant for the period-proportional voltage-controlled oscillator (see curve 46).

When the input audio signal is a string voice, a string chorus effect is achieved with the string chorus generated by the present invention. Although primarily developed for string chorus, other useful effects can be obtained with other voicing, e.g., a desirable ensemble effect is produced when flute tones are applied as the audio input to the system of the present invention.

While the preferred embodiment of the invention has been illustrated and described, it is to be understood that the invention is not limited to the precise construction herein disclosed, and the right is reserved to all changes and modifications coming within the scope of the invention as defined in the appended claims.

We claim:

1. In an electronic musical instrument, a delay modulation apparatus for providing a modulation effect, said apparatus comprising:

an audio signal source;

processor means for providing a one bit wide binary digital pulse train from a lookup table within said processor means, wherein each bit in the pulse train corresponds to the variation in amplitude of an analog modulation control signal waveform at a sample point relative to the amplitude at a previous sample point;

first filter means for integrating the digital pulse train provided by said processor means to provide an analog modulation control signal;

voltage-controlled oscillator means for receiving the analog modulation control signal provided by said filter means and providing an output clock signal having a period which is a function of the amplitude of the analog modulation control signal;

analog delay means for receiving the clock signal and having an input for receiving an audio input signal from said audio signal source, said analog delay means also having an output at which said analog delay means produces a delayed output signal corresponding to the audio input signal delayed in time for a period directly proportional to the period of the clock signal; and second filter means for filtering the delayed audio output signal provided by said analog delay means to provide a delay modulated audio output signal.

2. The apparatus as claimed in claim 1 wherein said voltage-controlled oscillator means provides an output clock signal having a period that is directly proportional to the amplitude of the analog modulation control signal.

3. The apparatus as claimed in claim 1 wherein the pulse train provided by said processor means corresponds to a first low frequency signal superimposed on a second low frequency signal.

4. The apparatus as claimed in claim 3 wherein said voltage-controlled oscillator means provides an output clock signal having a frequency that is directly proportional to the amplitude of the analog modulation control signal and wherein the amplitude of the first low frequency signal varies as a function of time and of the instantaneous amplitude of the second low frequency signal, whereby the modulating effect on the audio input signal is comparable to that which would result if the amplitude of the first low frequency signal did not vary as a function of the amplitude of the second low frequency signal but had a modulating effect that remained constant regardless of the instantaneous amplitude of the second low frequency signal.

5. The apparatus as claimed in claim 1 wherein said processor means further comprises a lookup table in which is stored bits corresponding to a period of the pulse train, the lookup table being read repetitively by said processor to provide the pulse train.

6. In an electronic musical instrument, a chorus generator apparatus for producing ensemble effects from an audio signal, said apparatus comprising:

processor means for providing a plurality of one bit wide binary pulse trains corresponding to a plurality of waveforms, wherein each bit in each of the pulse trains corresponds to the variation in the amplitude of an analog modulation control signal waveform at a sample point relative to the amplitude at a previous sample point;

a first plurality of low-pass filters for integrating each of the plurality of pulse trains provided by said processor means to provide a plurality of modulation control signals;

a plurality of oscillators for providing a plurality of clock signals, the clock signal provided by each of said plurality of oscillators having a period that is a function of the amplitude of a corresponding modulation control signal received from a corresponding one of said plurality of low-pass filters;

a plurality of analog shift registers for providing an output signal corresponding to the audio signal after being delay modulated, the delay modulation introduced by each of said analog shift registers being directly proportional to the period of a clock signal received from a corresponding one of said plurality of oscillators; and a second plurality of low-pass filters for filtering the output signals from said plurality of analog shift registers, whereby a plurality of delayed audio output signals corresponding to the delay modulated audio signal is provided.

7. The apparatus as claimed in claim 6 further comprising:

a plurality of output channels, each of said channels including an audio output system; and connecting means for connecting pairs of said delayed audio output signals provided by said second plurality of low-pass filters to one of said plurality of output channels, whereby when the signals on said plurality of output channels are sounded by the respective audio systems an ensemble effect is achieved.

8. The apparatus as claimed in claim 6 in which each of the pulse trains provided by said processor means differs in phase from the other pulse trains, the phase of the pulse trains being generated by said processor means scanning a plurality of different locations of a common lookup table substantially simultaneously to provide a plurality of independent pulse trains.

9. In an electronic musical instrument, a chorus generator apparatus for producing ensemble effects from an audio signal, said apparatus comprising:

an audio signal source for providing an audio signal;

processor means for providing a plurality of one bit wide binary digital pulse trains corresponding to a plurality of modulating control signals, wherein each bit in each of the pulse trains corresponds to the variation in the amplitude of an analog modulation control signal waveform at a sample point relative to the amplitude at a previous sample point, said processor means having a lookup table in which are stored bits corresponding to a period of a pulse train, the lookup table being read repetitively at a plurality of different locations substantially simultaneously by said processor to provide the plurality of digital pulse trains; and a plurality of delay line circuits for receiving said plurality of pulse trains and for delay modulating the audio signal provided by said audio signal source, each of said plurality of delay line circuits delay modulating the audio signal by an amount directly proportional to a corresponding one of the plurality of modulating control signals, whereby a plurality of delay modulated audio output signals is provided.

10. In an electronic musical instrument, a chorus generator apparatus for producing ensemble effects from an audio signal, said apparatus comprising:

an audio signal source;

processor means for providing a plurality of one bit wide binary digital pulse trains from a lookup table, wherein each bit in each of the pulse trains corresponds to the variation in the amplitude of an analog modulation control signal waveform at a sample point relative to the amplitude at a previous sample point;

filter means for integrating the plurality of digital pulse trains provided by said processor means to provide a plurality of analog modulation control signals;

voltage-controlled oscillator means for receiving the plurality of analog modulation control signals provided by said filter means and providing a plurality of clock signals, each of the clock signals having a period which is a function of the amplitude of an analog modulation control signal from said plurality of analog modulation control signals;

analog delay means for receivng the plurality of clock signals and having an input for receiving an audio input signal from said audio signal source, said analog delay means producing a plurality of delayed output signals, each of the delayed output signals corresponding to the audio input signal delayed in time for a period directly proportional to the period of a clock signal from said plurality of clock signals; and second filter means for filtering the plurality of delayed output signals provided by said analog delay means to provide a plurality of delay modulated audio output signals.

11. The apparatus as claimed in claim 10 wherein said voltage-controlled oscillator means provides a plurality of clock signals, each of the clock signals having a period that is directly proportional to the amplitude of an analog modulation control signal from said plurality of analog modulation control signals.

12. The apparatus as claimed in claim 10 or 11 wherein each digital pulse train in the plurality of digital pulse trains provided by said processor means corresponds to a first low frequency signal superimposed on a second low frequency signal.

13. The apparatus as claimed in claim 10 wherein said voltage-controlled oscillator means provides a plurality of clock signals, each of the clock signals having a frequency that is directly proportional to the amplitude of an analog modulation control signal from said plurality of analog modulation control signals, each of the modulation control signals corresponding to a first low frequency signal superimposed on a second low frequency signal, and wherein the amplitude of the first low frequency signal varies as a function of time and of the instantaneous amplitude of the second low frequency signal for each digital pulse train, whereby the modulating effect on the audio input signal is comparable to that which would result if the amplitude of the first low frequency signal did not vary as a function of the amplitude of the second low frequency signal but had a modulating effect that remained constant regardless of the instantaneous amplitude of the second low frequency signal.

14. The apparatus as claimed in claim 10 wherein said processor means further comprises a plurality of lookup tables in each of which is stored bits corresponding to a period of a pulse train, each lookup table being read repetitively by said processor to provide a pulse train.

15. The apparatus as claimed in claim 1, 6 or 10, wherein said processor means comprises a sequential addressing means and digital memory means.

16. The apparatus as claimed in claim 15 wherein said sequential addressing means and digital memory means further comprises:

a read only memory in which are stored bits corresponding to a period of a pulse train; and counter means for repetitively accessing said read only memory whereby a digital pulse train is provided.

* * * * *

UNITED STATES PATENT AND TRADEMARK OFFICE

CERTIFICATE OF CORRECTION

PATENT NO. : 4,384,505

DATED : May 24, 1983

INVENTOR(S) : Robert B. Cotton, Jr., et al

It is certified that error appears in the above—identified patent and that said Letters Patent is hereby corrected as shown below:

Col. 1, line 18, "3,833,742" should be --3,833,752--.

Col. 3, line 23, "an other" should be --another--.

Col. 6, line 1, "and" should be --the--.

Signed and Sealed this

Ninth Day of August 1983

[SEAL]

*Attest:*

GERALD J. MOSSINGHOFF

*Attesting Officer*

*Commissioner of Patents and Trademarks*